US011724411B2

(12) United States Patent
Park et al.

(10) Patent No.: US 11,724,411 B2
(45) Date of Patent: Aug. 15, 2023

(54) SHAVER

(71) Applicant: DORCO CO., LTD., Seoul (KR)

(72) Inventors: Young Ho Park, Gunpo-si (KR); Byung Sun An, Ansan-si (KR)

(73) Assignee: DORCO CO., LTD., Seoul (KR)

( * ) Notice: Subject to any disclaimer, the term of this patent is extended or adjusted under 35 U.S.C. 154(b) by 0 days.

(21) Appl. No.: 17/747,506

(22) Filed: May 18, 2022

(65) Prior Publication Data

US 2022/0274273 A1 Sep. 1, 2022

Related U.S. Application Data

(63) Continuation of application No. 16/856,728, filed on Apr. 23, 2020, now Pat. No. 11,358,293, which is a continuation of application No. 16/132,290, filed on Sep. 14, 2018, now Pat. No. 10,661,460, which is a continuation of application No. 15/867,996, filed on Jan. 11, 2018, now Pat. No. 10,245,739, which is a continuation of application No. 15/416,170, filed on Jan. 26, 2017, now Pat. No. 9,902,077, which is a continuation of application No. 12/306,626, filed as application No. PCT/KR2007/003110 on Jun. 27, 2007, now Pat. No. 9,604,373.

(30) Foreign Application Priority Data

Jun. 29, 2006 (KR) ..... 10-2006-0059004

(51) Int. Cl.

| | |
|---|---|
| ***B26B 21/22*** | (2006.01) |
| ***B26B 21/52*** | (2006.01) |
| ***B26B 21/40*** | (2006.01) |

(52) U.S. Cl.
CPC ..... *B26B 21/225* (2013.01); *B26B 21/4012* (2013.01); *B26B 21/4068* (2013.01); *B26B 21/521* (2013.01)

(58) Field of Classification Search
CPC ..... B26B 21/22; B26B 21/225; B26B 21/521; B26B 21/4012; B26B 21/4068
USPC ..... 30/47–51, 526, 527
See application file for complete search history.

(56) References Cited

U.S. PATENT DOCUMENTS

| | | | |
|---|---|---|---|
| 3,593,416 | A | 7/1971 | Edson |
| 3,816,912 | A | 6/1974 | Glaberson |

(Continued)

FOREIGN PATENT DOCUMENTS

| | | |
|---|---|---|
| CA | 2945100 | 10/2015 |
| CN | 1270548 A | 10/2000 |

(Continued)

*Primary Examiner* — Jason Daniel Prone
(74) *Attorney, Agent, or Firm* — Knobbe, Martens, Olson & Bear, LLP

(57) ABSTRACT

Provided is a shaver including a cartridge and a handle body. The cartridge includes a cartridge body formed in a rectangular frame shape; a plurality of blades installed in the cartridge body in the side-to-side direction of the cartridge body, each of the blades having a front portion bent downward; pair of side fixation slots formed on left and right frames of the cartridge body, respectively, so as to fix the left and right ends of each blade; a supporter connecting upper and lower frames of the cartridge body; and an inside fixation slot formed on the supporter so as to fix a portion of each blade. The handle body is coupled to the cartridge body.

8 Claims, 5 Drawing Sheets

(56) References Cited

U.S. PATENT DOCUMENTS

| | | | |
|---|---|---|---|
| 3,816,913 | A | 6/1974 | Ferraro |
| 4,083,104 | A | 4/1978 | Nissen et al. |
| 4,125,243 | A | 11/1978 | Liptak |
| 4,200,976 | A | 5/1980 | Gooding |
| 4,227,302 | A | 10/1980 | Torrance |
| 4,253,235 | A | 3/1981 | Jacobson |
| 4,257,160 | A | 3/1981 | Murai |
| 4,266,340 | A | 5/1981 | Bowman |
| 4,270,268 | A | 6/1981 | Jacobson |
| 4,283,850 | A | 8/1981 | Douglass et al. |
| 4,288,920 | A | 9/1981 | Douglass et al. |
| 4,302,876 | A | 12/1981 | Emmett |
| 4,378,633 | A | 4/1983 | Jacobson |
| 4,378,634 | A | 4/1983 | Jacobson |
| 4,389,773 | A | 6/1983 | Nissen et al. |
| 4,446,619 | A | 5/1984 | Jacobson |
| 4,475,286 | A | 10/1984 | Saito |
| 4,488,357 | A | 12/1984 | Jacobson |
| 4,556,183 | A | 12/1985 | Greenberger |
| 4,621,424 | A | 11/1986 | Jacobson |
| 4,879,811 | A | 11/1989 | Cooney |
| D306,529 | S | 3/1990 | Goodell |
| 4,932,122 | A | 6/1990 | Shurland et al. |
| 5,010,646 | A | 4/1991 | Neamtu |
| 5,016,352 | A | 5/1991 | Metcalf |
| 5,144,887 | A | 9/1992 | Mietzel |
| 5,157,834 | A | 10/1992 | Chen et al. |
| 5,182,858 | A | 2/1993 | Chen |
| 5,224,267 | A | 7/1993 | Simms et al. |
| 5,313,706 | A | 5/1994 | Motta et al. |
| 5,347,715 | A | 9/1994 | Friedland |
| 5,347,717 | A | 9/1994 | Ts'ai |
| 5,416,974 | A | 5/1995 | Wain |
| 5,482,276 | A | 1/1996 | Hall |
| 5,505,421 | A | 4/1996 | Marthaler |
| 5,669,139 | A | 9/1997 | Oldroyd et al. |
| 5,671,534 | A | 9/1997 | Mayerovitch |
| 5,687,485 | A | 11/1997 | Shurtleff et al. |
| 5,761,814 | A | 6/1998 | Anderson et al. |
| 5,822,862 | A | 10/1998 | Ferraro |
| 5,857,654 | A | 1/1999 | Berman |
| D410,452 | S | 6/1999 | Ancona et al. |
| 5,956,848 | A | 9/1999 | Tseng et al. |
| 5,956,851 | A | 9/1999 | Apprille et al. |
| 6,041,926 | A | 3/2000 | Petricca et al. |
| 6,052,903 | A | 4/2000 | Metcalf et al. |
| D428,606 | S | 7/2000 | Ancona et al. |
| 6,185,822 | B1 | 2/2001 | Tseng et al. |
| 6,212,777 | B1 | 4/2001 | Gilder et al. |
| 6,223,442 | B1 | 5/2001 | Pina |
| 6,311,400 | B1 | 11/2001 | Hawes et al. |
| D453,534 | S | 2/2002 | Kosir |
| 6,397,473 | B1 | 6/2002 | Clark |
| 6,425,184 | B1 | 7/2002 | Min |
| 6,434,839 | B1 | 8/2002 | Lee et al. |
| 6,442,839 | B1 | 9/2002 | Tseng et al. |
| 6,516,518 | B1 | 2/2003 | Garraway et al. |
| 6,560,881 | B2 | 5/2003 | Coffin |
| 6,612,040 | B2 | 9/2003 | Gilder |
| 6,671,961 | B1 | 1/2004 | Santhagens Van Eibergen et al. |
| 6,678,977 | B1 | 1/2004 | Sherman |
| 6,684,513 | B1 | 2/2004 | Clipstone et al. |
| 6,804,886 | B2 | 10/2004 | Wain |
| 6,807,739 | B2 | 10/2004 | Folio |
| 6,877,227 | B2 | 4/2005 | Santhagens Van Eibergen et al. |
| 6,948,249 | B2 | 9/2005 | Barone et al. |
| 7,103,976 | B2 | 9/2006 | Pennella |
| 7,111,401 | B2 | 9/2006 | Richard |
| 7,155,852 | B2 | 1/2007 | Vogler |
| 7,200,942 | B2 | 4/2007 | Richard |
| 7,526,869 | B2 | 5/2009 | Blatter et al. |
| 7,574,809 | B2 | 8/2009 | Follo et al. |
| 7,676,929 | B2 | 3/2010 | Lembke et al. |
| 7,730,619 | B2 | 6/2010 | Ozenick |
| 7,877,879 | B2 | 2/2011 | Nakasuka |
| 8,146,255 | B2 | 4/2012 | Denkert et al. |
| 8,166,661 | B2 | 5/2012 | King |
| 8,234,789 | B2 | 8/2012 | Avens et al. |
| 8,359,752 | B2 | 1/2013 | Bridges |
| 8,381,406 | B2 | 2/2013 | Miyazaki |
| 8,561,300 | B2 | 10/2013 | Rehbein et al. |
| 8,590,162 | B2 | 11/2013 | Park et al. |
| 8,732,955 | B2 | 5/2014 | Howell et al. |
| 8,739,411 | B2 | 6/2014 | Kinghorn |
| 8,793,880 | B2 | 8/2014 | Taub et al. |
| 8,938,885 | B2 | 1/2015 | Stevens |
| 9,469,038 | B2 | 10/2016 | Iaccarino et al. |
| 9,604,373 | B2 | 3/2017 | Park et al. |
| 9,616,584 | B2 | 4/2017 | Coresh |
| 9,694,503 | B2 | 7/2017 | Papadopoulos-Papageorgis et al. |
| 9,701,034 | B2 | 7/2017 | Papadopoulos-Papageorgis et al. |
| 9,707,688 | B2 | 7/2017 | Giannopoulos et al. |
| 9,718,201 | B2 | 8/2017 | Swenson |
| 9,731,426 | B2 | 8/2017 | Kim et al. |
| 9,757,870 | B2 | 9/2017 | Giannopoulos et al. |
| 9,902,077 | B2 | 2/2018 | Park et al. |
| 10,022,882 | B2 | 7/2018 | Griffin et al. |
| 10,052,776 | B2 | 8/2018 | Provost et al. |
| 10,245,739 | B2 | 4/2019 | Park et al. |
| 10,661,460 | B2 | 5/2020 | Park et al. |
| 11,273,564 | B2 * | 3/2022 | Park ..... B26B 21/521 |
| 11,358,293 | B2 * | 6/2022 | Park ..... B26B 21/4012 |
| 2002/0104223 | A1 | 8/2002 | Oldroyd |
| 2002/0116831 | A1 | 8/2002 | Coffin |
| 2002/0144404 | A1 | 10/2002 | Gilder et al. |
| 2003/0213130 | A1 | 11/2003 | Motta |
| 2004/0181953 | A1 | 9/2004 | Follo et al. |
| 2004/0181954 | A1 | 9/2004 | Follo et al. |
| 2005/0039338 | A1 | 2/2005 | King et al. |
| 2005/0102847 | A1 | 5/2005 | King |
| 2005/0193572 | A1 | 9/2005 | Gilder |
| 2006/0080839 | A1 | 4/2006 | Hesketh |
| 2006/0218804 | A1 | 10/2006 | Noble et al. |
| 2008/0250647 | A1 | 10/2008 | Fischer et al. |
| 2009/0293281 | A1 | 12/2009 | Bruno |
| 2010/0077617 | A1 | 4/2010 | Peterson et al. |
| 2010/0251555 | A1 | 10/2010 | Park et al. |
| 2011/0232101 | A1 | 9/2011 | Park et al. |
| 2011/0247217 | A1 | 10/2011 | Johnson et al. |
| 2012/0210586 | A1 | 8/2012 | Lelieveld et al. |
| 2014/0331500 | A1 | 11/2014 | Ren |
| 2014/0352154 | A1 | 12/2014 | Ortins et al. |
| 2015/0306777 | A1 | 10/2015 | Georgakis et al. |
| 2016/0107324 | A1 | 4/2016 | Robertson et al. |
| 2016/0144519 | A1 | 5/2016 | Hahn et al. |
| 2016/0167242 | A1 | 6/2016 | Noh et al. |
| 2017/0136639 | A1 | 5/2017 | Park et al. |
| 2018/0194026 | A1 | 7/2018 | Park et al. |
| 2019/0337174 | A1 | 11/2019 | Kopelas et al. |
| 2020/0078969 | A1 | 3/2020 | Gratsias et al. |
| 2020/0316796 | A1 | 10/2020 | Park et al. |
| 2021/0094198 | A1 | 4/2021 | Chatzigrigoriou et al. |
| 2021/0213630 | A1 | 7/2021 | Chatzigrigoriou et al. |

FOREIGN PATENT DOCUMENTS

| | | | |
|---|---|---|---|
| EP | 1531030 | A2 | 5/2005 |
| WO | 9621983 | A1 | 9/1996 |
| WO | 2008002069 | A1 | 1/2008 |
| WO | 2010093133 | | 8/2010 |
| WO | 2016010825 | | 1/2016 |
| WO | 2016087007 | | 6/2016 |
| WO | 2016203326 | | 12/2016 |

* cited by examiner

[Fig. 1]
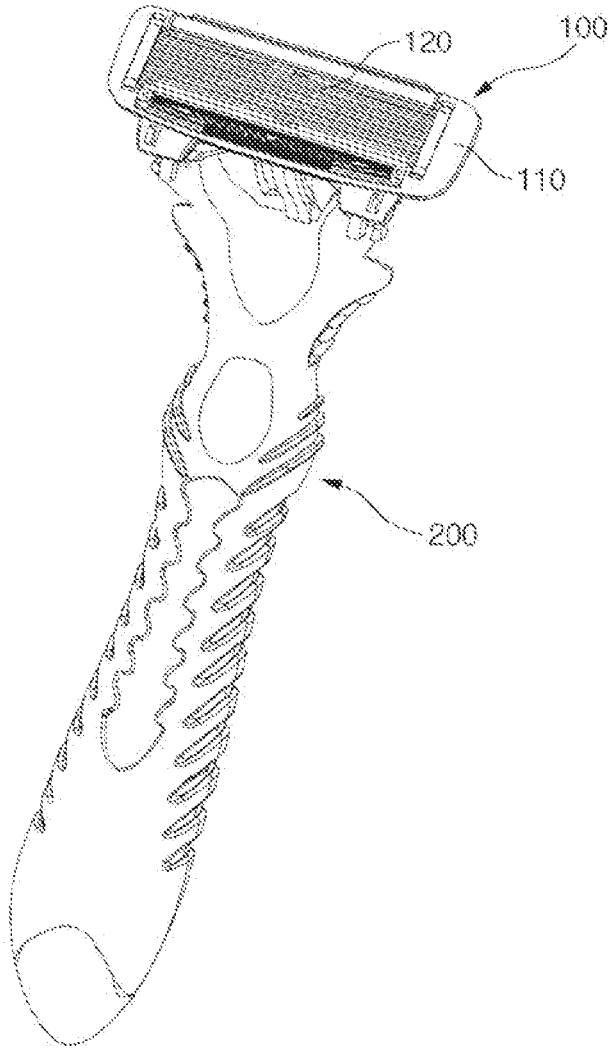

[Fig. 2]
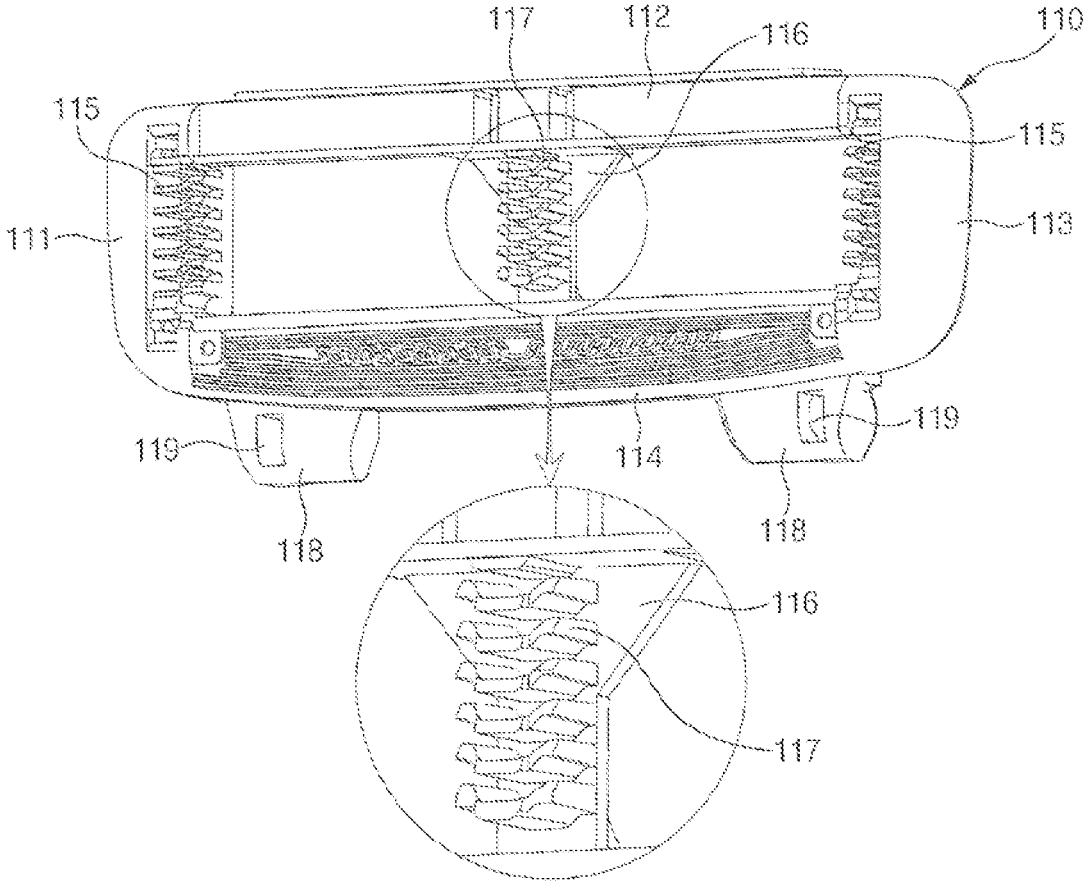
[Fig. 3]
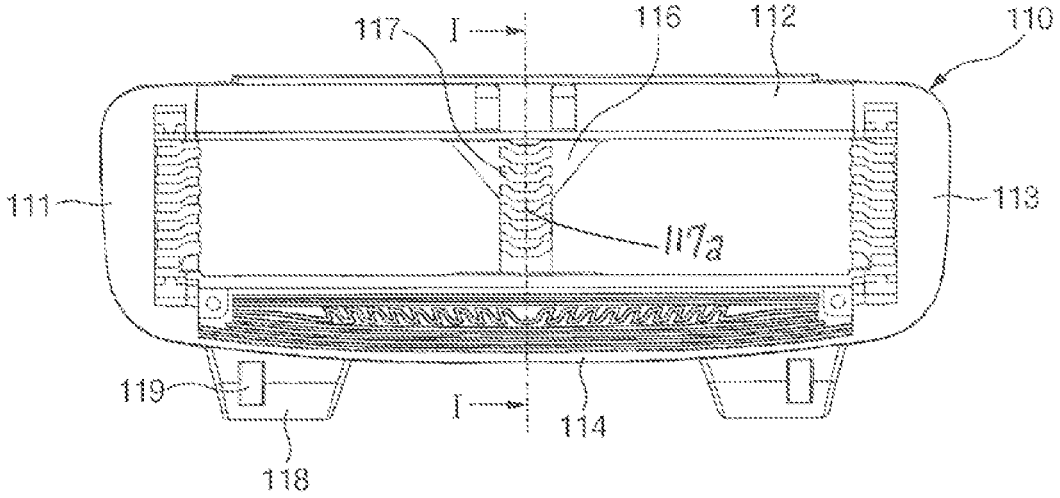

[Fig. 4]
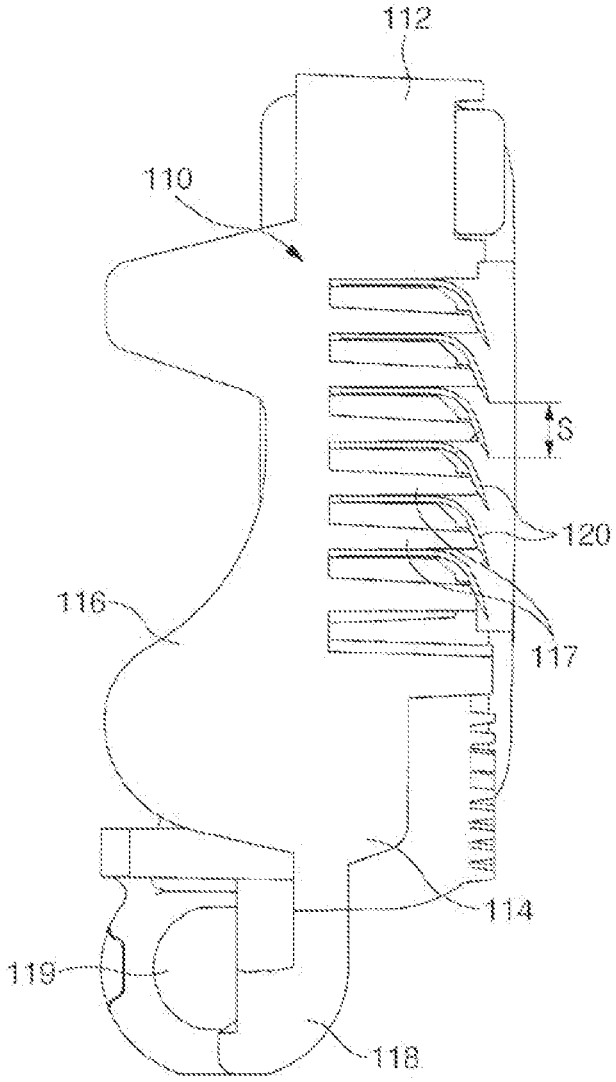
[Fig. 5]
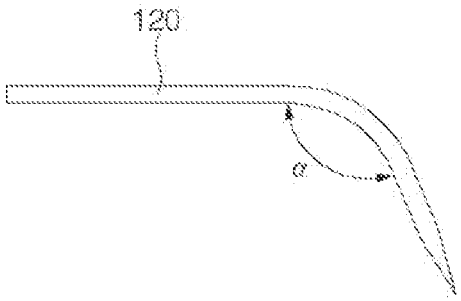

[Fig. 6]
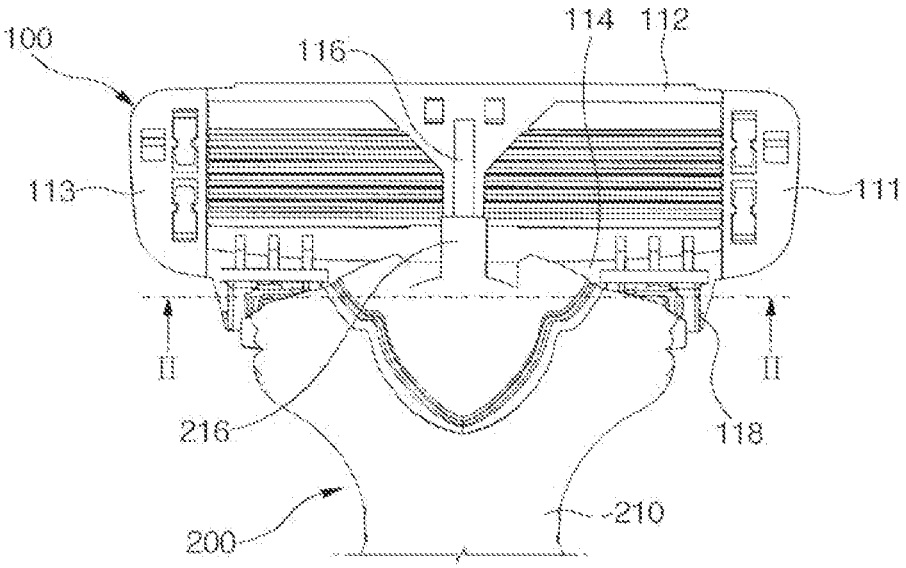
[Fig. 7]
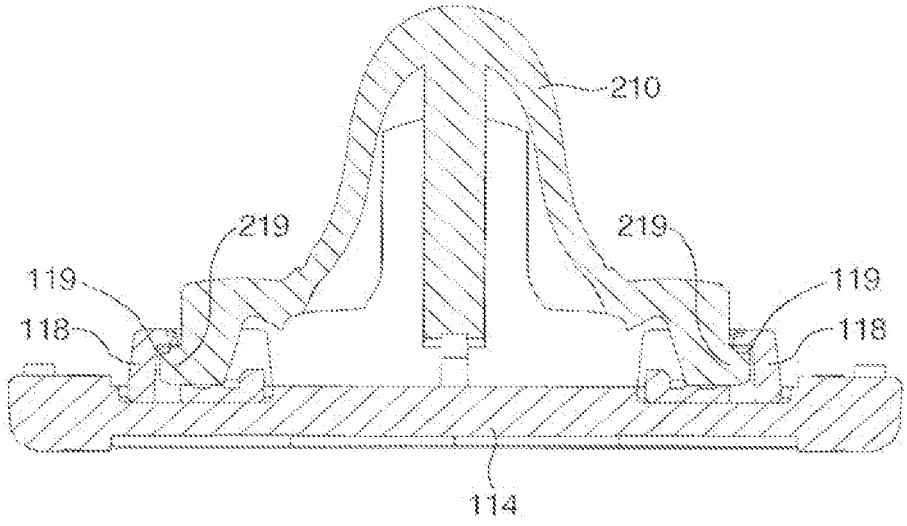

[Fig. 8]
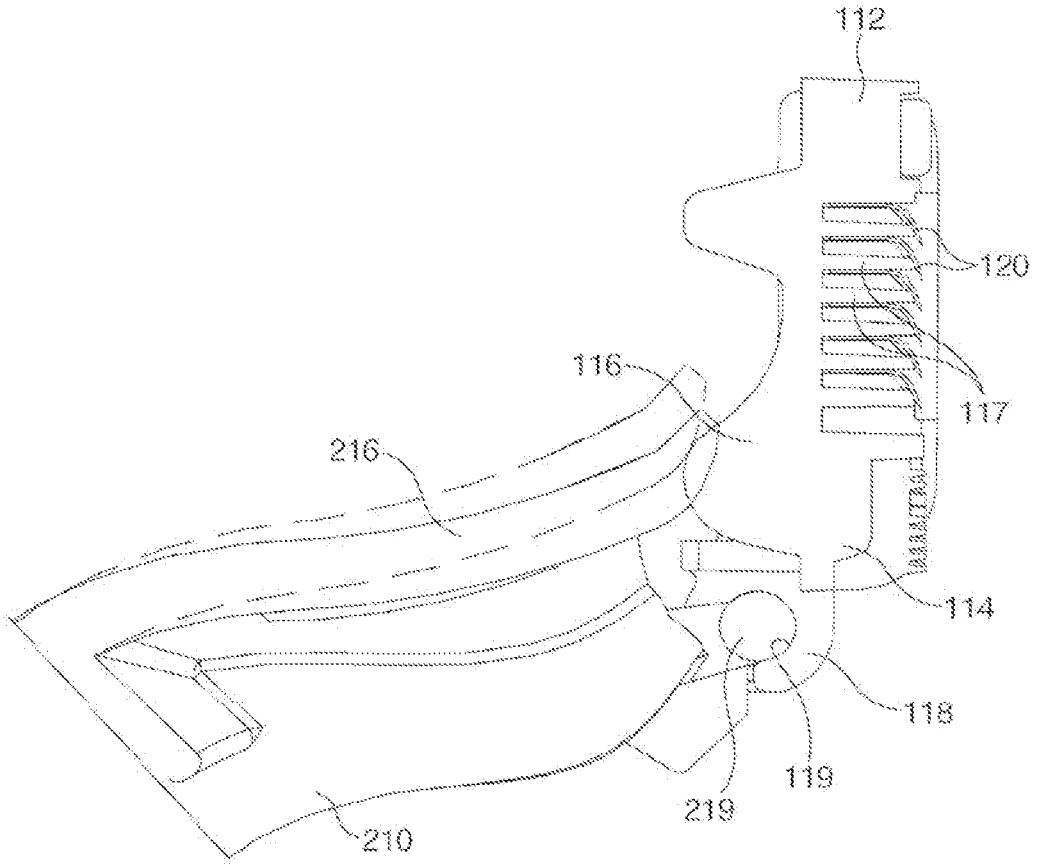

SHAVER

This application is a continuation of U.S. patent application Ser. No. 16/856,728, filed on Apr. 23, 2020, now U.S. Pat. No. 11,358,293, which is a continuation of U.S. patent application Ser. No. 16/132,290, filed on Sep. 14, 2018, now U.S. Pat. No. 10,661,460, which is a continuation of U.S. patent application Ser. No. 15/867,996, filed on Jan. 11, 2018, now U.S. Pat. No. 10,245,739, which is a continuation of U.S. patent application Ser. No. 15/416,170, filed on Jan. 26, 2017, now U.S. Pat. No. 9,902,077, which is a continuation of U.S. patent application Ser. No. 12/306,626, filed on Dec. 24, 2008, now U.S. Pat. No. 9,604,373, which is the National Stage filing under 35 U.S.C. 371 of International Application No. PCT/KR2007/003110, filed on Jun. 27, 2007, which claims the benefit of earlier filing date and right of priority to Korean Patent Application No. 10-2006-0059004, filed on Jun. 29, 2006, the contents of which are all hereby incorporated by reference herein their entirety.

TECHNICAL FIELD

The present invention relates to a shaver, and more specifically, to a shaver of which the washability, the shaving performance, the stability, and the operating performance can be enhanced.

BACKGROUND ART

In general, a conventional shaver includes a cartridge, on which a plurality of blades for cutting hair such as beard are mounted, and a handle assembly which is held by a user's hand during shaving.

In a state where the cartridge and the handle assembly are coupled to each other, the user holds the handle assembly by hand and closely contacts the cartridge onto the user's skin. Then, the user shaves beard through the blades.

In order to enhance shaving efficiency, the plurality of blades are mounted on the cartridge at a variable distance from each other.

However, when the conventional shaver is used for a long time, sludge composed of beard and other foreign substance is clogged between the blades so as not to be discharged. Therefore, the shaving performance of the shaver is degraded, and the sludge is difficult to wash away.

Further, as the sludge is clogged, various bacterium proliferate, which are harmful to body.

In addition, the conventional shaver has such a structure that both ends of each blade are fixed to the cartridge. Therefore, since a force for fixing the blade is weak, the stability of the shaver decreases.

Furthermore, the cartridge and the handle assembly of the shaver are coupled to each other through a hinge method. In this structure, the swing operation of the cartridge is simply supported by a hinge. Therefore, the surface contact force of the cartridge is so weak that the shaving performance and the operating performance of the shaver are degraded.

DISCLOSURE OF INVENTION

Technical Problem

The present invention provides a shaver which smoothly discharges sludge generated during shaving such that the washability thereof is enhanced. In the shaver, a force for fixing blades is enhanced so as to improve the shaving performance thereof, and a swing operation of a cartridge is elastically supported so as to enhance the stability and the operating performance thereof.

Technical Solution

According to an aspect of the invention, a shaver comprises a cartridge and a handle body. The cartridge includes a cartridge body formed in a rectangular frame shape; a plurality of blades installed in the cartridge body in the side-to-side direction of the cartridge body, each of the blades having a front portion bent downward; pair of side fixation slots formed on left and right frames of the cartridge body, respectively, so as to fix the left and right ends of each blade; a supporter connecting upper and lower frames of the cartridge body; and an inside fixation slot formed on the supporter so as to fix a portion of each blade. The handle body is coupled to the cartridge body.

The inside fixation slot may be formed in a wave shape along the side-to-side direction of the cartridge body.

The plurality of blades may be installed at a variable distance from each other along the top-to-bottom direction of the cartridge body, and the side fixation slots and the inside fixation slot may be formed to correspond to the number of the installed blades and the distance between the installed blades.

The cartridge body and the handle body may be coupled to each other through front hinge mounting.

The cartridge body may have a hinge portion formed on either end of the lower frame thereof, the hinge portion having a hinge groove, and the handle body may have a hinge protrusion formed on either upper end thereof, the hinge protrusion being coupled to the hinge groove.

The handle body may have an elastic portion projecting from an upper portion thereof, the elastic portion being closely contacted with the rear surface of the supporter when the handle body is coupled to the cartridge body, and a swing operation of the cartridge body may be elastically performed by the elastic force of the elastic portion.

The rear surface of the supporter may be convexly curved.

Advantageous Effects

The effects of the shaver according to the invention will be described.

Firstly, since the front portions of the blades are bent downwardly and the cartridge body is formed in a rectangular frame shape, sludge generated during shaving is smoothly discharged to the outside. Therefore, it is possible to improve washability.

Secondly, a portion of each blade is fixed by the inside fixation slot such that the force for fixing the blade is enhanced. Therefore, it is possible to improve the stability and shaving performance of the shaver.

Thirdly, since the swing operation of the cartridge is elastically supported, the contact force of the blade with respect to the skin during shaving is enhanced. Therefore, it is possible to improve the shaving performance and operating performance of the shaver.

BRIEF DESCRIPTION OF THE DRAWINGS

FIG. 1 is a perspective view of a shaver according to the present invention.

FIG. 2 is a perspective view of a cartridge of the shaver according to the invention.

FIG. 3 is a front view of the cartridge of the shaver according to the invention.

FIG. 4 is a cross-sectional view taken along line I-I of FIG. 3.

FIG. 5 is a side view of blades of the shaver according to the invention.

FIG. 6 is a rear view of the shaver according to the invention, showing a state where a cartridge and a handle assembly are coupled to each other.

FIG. 7 is a cross-sectional view taken along line II-II of FIG. 6.

FIG. 8 is a side view illustrating an operating structure of the shaver according to the invention.

BEST MODE FOR CARRYING OUT THE INVENTION

Hereinafter, a shaver according to an embodiment of the invention will be described with reference to FIGS. 1 to 8.

As shown in FIG. 1, the shaver according to the invention includes a cartridge 100 having a plurality of blades 120 mounted thereon and a handle assembly 200 coupled to the cartridge 100.

As shown in FIG. 2, the cartridge 100 includes a cartridge body 110 formed in a rectangular frame shape, the plurality of blades 120 (refer to FIG. 1) installed in the cartridge body 110 in the horizontal direction, plural pairs of side fixation slots 115 are formed on opposing side frame portions 11 and 113 of the cartridge body 110 so as to fix a plurality of blades 120 therein, a supporter 116 for connecting opposing upper and lower frame portions 112 and 114 of the cartridge body 110, a plurality of inside fixation slots 117 each formed on the support 116 so as to fix a portion of each blade 120, and a pair of hinge portions 118 each having a hinge groove 119 for coupling to the handle assembly 200 through front hinge mounting.

As shown in FIG. 3, each inside fixation slot 117 has a waved groove shape in the horizontal direction of the cartridge body 110, the waved groove shape defining an inside convex portion 117*a* and including inclined and declined surfaces making up the waved groove shape as shown in FIGS. 2 and 3.

In the embodiment shown, the inside fixation slot 117 has a side-to-side width and shape so as to reliably fix the blade 120 therein. Preferably, the inside fixation slot 117 has such a width that sludge or waste materials, such as beard cut by the blades 120 and other foreign substance, can be smoothly discharged there-through. For example, the inside fixation slot 117 may be formed to have a side-to-side width of about 2.5 mm.

Each of the side fixing slots 115 is formed in a shape corresponding to the inside fixation slot 117, including similar waved groove shapes including inclined and declined surfaces. In this embodiment, since the side fixation slots 115 are formed in the left and right frame portions 111 and 113 of the cartridge body 110, respectively, it is preferable that the width of the side fixation slots 115 is set to be smaller than that of the inside fixation slot 117.

According to the present invention, one inside fixation slot 117 can be provided at a substantially central position between two side fixation slots 115 to fix and support one blade. However, a plurality of inside fixation slots 117 may be provided between the corresponding side fixation slots 115 so as to fix a plurality of blades 120 reliably. It is also contemplated that a plurality of supporters 116 can be provided to have the plurality of inside fixation slots 117 thereon.

Further, the inside fixation slot 117 should be spaced to a proper distance from the two corresponding side fixation slots 115, in order to support the blades 120 more securely with the inside fixation slot 117.

As the thickness of the blade 120 decreases, the distance between the inside fixation slot 117 and the side fixation slots 115 should preferably be reduced. For example, when the thickness of the blade 120 is set in the range of 0.075 to 0.15 mm, the distance between the inside fixation slot 117 and the side fixation slot 115 is preferably set to about 15 mm.

Accordingly, the left and right ends of each blade 120 are fixed and supported by the side fixation slots 115, and a central or inner side portion of the blade 120 is fixed and supported by the inside fixation slot 117. Therefore, a force for supporting the blade 120 is increased, thereby improving the stability and shaving performance during shaving.

As shown in FIG. 4, the plurality of blades 120 are installed to have a predetermined displacement distance from one another along the top-to-bottom direction of the cartridge body 110. That is, the plurality of blades 120 may be installed at same interval or different intervals from each other along the top-to-bottom direction of the cartridge body 110.

As such, the inside fixation slots 117 can be located to have a specific interval selected depending on the number of installed blades 120. Likewise, the side fixation slots 115 can also be located to have such an interval selected depending on the number of installed blades 120.

That is, when the plurality of blades 120 are installed in the cartridge body 110, a predetermined number of blades 120 can be installed at an optimum interval from each other in the side fixation slots 115 and the inside fixation slots 117.

Meanwhile, as shown in FIGS. 4 and 5, the front portion of each blade 120 is bent downwardly from the rear portion thereof.

The blades 120 can be manufactured in the order of punching, heat-treatment, grinding, coating, and bending.

The blades 120 are made to have a proper length and thickness. For example, the overall length of the blade 120 may be set in the range of 3.0 to 4.0 mm, and the thickness thereof may be set in the range of 0.075 to 0.15 mm.

The front portion of each blade 120 is bent downwardly with a proper length and at a proper angle. Preferably, the length of the bent portion of the blade 120 ranges from 0.6 to 1.0 mm, and the front portion forms an angle $\alpha$ with the rear portion, which ranges from 108 to 115 degrees.

In order to accomplish smoother shaving with the plurality of blades 120, the front portions of the blades 120 are integrally bent downwardly from the rear portions thereof such that the distance (i.e., interval) S between the adjacent blades 120 can be set to have an optimally selected value.

That is, as the front portions of the blades 120 are bent from the rear portions thereof, sludge generated during shaving flows along continuous surfaces of the blades 120. Therefore, even though when the distance S between the blades 120 is set to a relatively small value, the sludge can be easily discharged, while a large amount of beard is easily cut. For example, the distance S between the blades 120 can be freely set in the range of 0.7 to 1.5 mm.

As the front portions of the blades 120 are bent downwardly, the distance between the front portions of the blades 120 is smaller than the distance between the rear portions thereof.

Therefore, sludge composed of beard cut by the blades 120 and other foreign substance can more easily flow from the front portions to the rear portions of the blades 120. Therefore, the washability of the shaver can be further enhanced.

In the shaver according to the invention, a predetermined number of blades 120 are installed at optimum interval in the cartridge body 110 such that a force for cutting beard during shaving can suitably be distributed onto the respective blades 120, thereby enhancing the cutting ability and lifespan of the blades 120.

Meanwhile, each of the inside fixation slots 117 may have an inclined surface formed on the front portion thereof such that the front portion of each blade 120 is suitably supported in accordance with the bending angle of the blade 120. For this, the inclined surface of each inside fixation slot 117 is closely contacted with one surface of the front portion of the blade 120.

Preferably, the rear portion of each blade 120 is contacted as closely as possible to the rear portion of each inside fixation slot 117 such that each blade 120 is reliably supported.

Therefore, each inside fixation slot 117 reliably supports the rear portion and the downwardly-bent front portion of each blade 120 such that the blade 120 is securely supported by the slot. Accordingly, it is possible to enhance the stability and operability of the shaver.

FIG. 6 illustrates a state in which 6, the handle body 210 of the handle assembly 200 is coupled to the cartridge body 110.

As shown in FIGS. 6 and 7, the handle body 210 has a pair of hinge protrusions 219 in both upper ends thereof. The hinge protrusions 219 are coupled to the hinge grooves 119 formed in the hinge portions 118 of the cartridge body 110 such that the handle body 210 is assembled into the cartridge body 110 through the front hinge mounting.

In the shaver according to the invention, the hinge portions 118 having the hinge grooves 119 are provided in both ends of the lower frame 114 of the cartridge body 110, and the hinge protrusions 219 coupled to the hinge grooves 119 are provided in both upper ends of the handle body 210. Therefore, the swing center of the cartridge 100 is provided in the lower end of the cartridge 100 such that the swing range of the cartridge 100 increases. Accordingly, shaving can be easily performed on a curved skin.

As shown in FIG. 6, the handle body 210 has an elastic portion 216 projecting from an upper portion thereof. The elastic portion 216 is closely contacted with the rear surface of the supporter 116 as the handle body 210 is coupled to the cartridge body 110.

That is, a swing operation of the cartridge body 110 is elastically supported by the elastic force of the elastic portion 216. Therefore, the contact force of the cartridge 100 with respect to the skin can be optimized, thereby improving the shaving performance of the shaver.

As shown in FIG. 8, it is preferable that the rear surface of the supporter 116 includes a non-planar convexly curved surface for this.

That is, due to the convex rear surface of the supporter 116 a further optimized compression force can be applied to the cartridge body 110 by the elastic portion 216 of the handle body 210, when the cartridge 100 is swung. In addition, a restoring force of the elastic portion 216 with respect to the convex compression surface is also optimized, so that the contact force of the cartridge 100 to the skin can be further optimized.

In addition, as the rear surface of the supporter 116 is convexly curved, a frictional force between the elastic portion 216 and the rear contact surface of the supporter 116 is minimized. Then, the swing operation of the cartridge 100 can be more smoothly performed, so that the operating performance of the shaver can be enhanced.

INDUSTRIAL APPLICABILITY

According to the shaver of the invention, sludge generated during shaving is smoothly discharged so that the washability of the shaver can be enhanced. The blades are reliably fixed so as to improve the shaving performance. Further, the swing operation of the cartridge is elastically supported, so that the stability and operating performance of the shaver can be enhanced.

What is claimed is:

1. A shaver comprising:

a handle comprising a hinge protrusion and a restoring protrusion; and a cartridge including:

a plurality of blades installed in a lengthwise direction of the cartridge;

a plurality of pairs of side supporting slots, each pair of the side supporting slots formed on left and right portions of the cartridge, respectively, so as to support left and right opposite ends of a corresponding blade of the plurality of blades;

a middle portion provided at a middle area between the left and right portions of the cartridge, wherein the middle portion comprises a rearwardly protruding surface at a rear of the middle portion; and a hinge groove formed toward a rear of the cartridge and configured to engage with the hinge protrusion of the handle to form a hinge allowing pivot of the cartridge with respect to the handle, wherein each pair of the side supporting slots includes:

first portions extended from the left and right portions of the cartridge, respectively; and second portions offset with respect to each of the first portions, respectively, and wherein:

a restoring force is provided to the cartridge by contact of the restoring protrusion of the handle against the rearwardly protruding surface during pivot movement of the cartridge.

2. The shaver of claim 1, wherein the restoring protrusion is located on an upper portion of the handle.

3. The shaver of claim 1, wherein the hinge groove is positioned toward a lower side of the cartridge.

4. The shaver of claim 1, wherein the rearwardly protruding surface is non-planar configured to allow the restoring protrusion to provide the restoring force during the pivot movement of the cartridge.

5. The shaver of claim 1, wherein the rearwardly protruding surface is convexly curved.

6. The shaver of claim 1, wherein each of the blades has a cutting edge and a rear supporting portion and each of the cutting edges is angled with respect to a respective one of the rear supporting portions.

7. The shaver of claim 6, wherein a distance between each of the cutting edges of the blades is less than a distance between respective ones of the rear supporting portions.

8. The shaver of claim 1, wherein a rear supporting portion of each of the plurality of blades is generally straight.

* * * * *